US009377735B2

(12) United States Patent
Takeda et al.

(10) Patent No.: US 9,377,735 B2
(45) Date of Patent: Jun. 28, 2016

(54) FIXING APPARATUS

(71) Applicant: CANON KABUSHIKI KAISHA, Tokyo (JP)

(72) Inventors: Isamu Takeda, Yokohama (JP); Satoshi Nishida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/706,860

(22) Filed: May 7, 2015

(65) Prior Publication Data

US 2015/0331375 A1 Nov. 19, 2015

(30) Foreign Application Priority Data

May 13, 2014 (JP) ..... 2014-099837

(51) Int. Cl.
*G03G 15/20* (2006.01)

(52) U.S. Cl.
CPC ..... *G03G 15/2064* (2013.01); *G03G 15/2053* (2013.01); *G03G 15/2057* (2013.01); *G03G 2215/2019* (2013.01)

(58) Field of Classification Search
CPC ..... G03G 15/2053; G03G 15/2064; G03G 15/2057; G03G 15/206; G03G 15/657; G03G 2215/2035; G03G 15/2017; G03G 15/2042; G03G 15/5008; G03G 2215/2016; G03G 2215/2019; G03G 15/167; G03G 15/6564
See application file for complete search history.

(56) References Cited

U.S. PATENT DOCUMENTS 6,229,982 B1 * 5/2001 Yamauchi ..... G03G 15/2025 118/60
2014/0023413 A1 * 1/2014 Shinji ..... G03G 15/2057 399/329

FOREIGN PATENT DOCUMENTS

| | | | |
|---|---|---|---|
| JP | H03-25481 | A | 2/1991 |
| JP | 2003-297530 | A | 10/2003 |
| JP | 2004-61700 | A | 2/2004 |
| JP | 2009-3047 | A | 1/2009 |
| JP | 2014-10318 | A | 1/2014 |

* cited by examiner

*Primary Examiner* — Roy Y Yi
(74) *Attorney, Agent, or Firm* — Canon USA, Inc., IP Division

(57) ABSTRACT

A fixing apparatus that heats, at a nip portion, a recording material, bearing a toner image, while conveying the recording material to fix the toner image thereto, includes a roller, a heating unit configured to contact the roller to form a heating portion with the roller, and heat the roller via the heating portion, wherein the heating unit includes a film, and a heating portion forming member configured to contact an inner surface of the film and form the heating portion with the roller via the film, and a backup member configured to contact the roller and form the nip portion with the roller. A micro hardness of a surface of the roller is lower than that of the film at the heating portion, and in at least a partial region of the heating portion, a velocity difference is provided between the surfaces of the roller and the film.

10 Claims, 12 Drawing Sheets

FIXING APPARATUS

BACKGROUND OF THE INVENTION

1. Field of the Invention

The present invention relates to a fixing apparatus used in an image forming apparatus such as an electro-photographic copying machine or printer.

2. Description of the Related Art

An external heating type fixing apparatus is known as a fixing apparatus used in an electro-photographic copying machine or printer. The external heating type fixing apparatus typically includes a fixing roller, a rotator for heating the fixing roller, and a backup member that is in contact with the fixing roller to form a nip portion. As the rotator for heating the fixing roller, a cylindrical film with which a heater is brought into contact, and a roller having a halogen heater therein can be used, for example. A recording material bearing an unfixed toner image is heated at the nip portion while being conveyed, and the unfixed toner image on the recording material is heat-fixed to the recording material.

In the external heating type fixing apparatus, offset toner adhering to the fixing roller may move and adhere to the rotator for heating the fixing roller. Because the rotator does not make contact with the recording material or does not have a cleaning unit, the toner tends to accumulate on the rotator. When the accumulated toner becomes a large lump, the lump may fall on the recording material being conveyed at the nip portion, causing a defective image.

Japanese Patent Application Laid-Open No. 3-25481 discusses a fixing apparatus in which the toner releasing property of a rotator is made higher than the toner releasing property of a fixing roller to prevent the offset toner on the surface of the fixing roller from adhering to the rotator for heating the fixing roller. In this fixing apparatus, the adhesion of the offset toner to the fixing roller is stronger than the adhesion of the offset toner to the rotator, and consequently, the offset toner on the fixing roller is more likely to accumulate on the surface of the fixing roller without adhering to the rotator. This prevents the offset toner from moving from the fixing roller to the rotator for heating the fixing roller.

However, in a heat-fixing operation for a recording material, paper dust such as paper fibers and loading materials (fillers) formed of inorganic substances such as calcium carbonate and talc contained in the recording material may adhere to the fixing roller although the adhesion amount is very small. Since the toner contained in contamination, which is a mixture of such paper dust and the offset toner moved to the fixing roller, has weak adhesion, the movement of the contamination from the fixing roller to the rotator may not be sufficiently suppressed only by the configuration discussed in Japanese Patent Application Laid-Open No. 3-25481.

SUMMARY OF THE INVENTION

According to an aspect of the present invention, a fixing apparatus that heats, at a nip portion, a recording material, bearing a toner image, while conveying the recording material to fix the toner image to the recording material includes a roller, a heating unit configured to be in contact with the roller to form a heating portion with the roller, and heat the roller via the heating portion, wherein the heating unit includes a film, and a heating portion forming member configured to be in contact with an inner surface of the film and form the heating portion with the roller via the film, and a backup member configured to be in contact with the roller and form the nip portion with the roller. A micro hardness of a surface of the roller is lower than a micro hardness of a surface of the film at the heating portion, and in at least a partial region of the heating portion, a velocity difference is provided between the surface of the roller and the surface of the film.

According to another aspect of the present invention, a fixing apparatus that heats, at a nip portion, a recording material, bearing a toner image, while conveying the recording material to fix the toner image to the recording material includes a roller, a heating rotator configured to be in contact with the roller and form a heating portion with the roller, and heat the roller via the heating portion, and a pressing rotator configured to be in contact with the roller and form the nip portion with the roller. A micro hardness of a surface of the roller is smaller than either of a micro hardness of a surface of the heating rotator at the heating portion and a micro hardness of a surface of the pressing rotator at the nip portion. Further, a first velocity difference is provided between the surface of the roller and the surface of the heating rotator in at least a partial region of the heating portion, and a second velocity difference is provided between the surface of the roller and the surface of the pressing rotator in at least a partial region of the nip portion, and a maximum value of the first velocity difference is larger than a maximum value of the second velocity difference.

Further features of the present invention will become apparent from the following description of exemplary embodiments with reference to the attached drawings.

DESCRIPTION OF THE EMBODIMENTS

(1) Image Forming Apparatus

Figure 1:
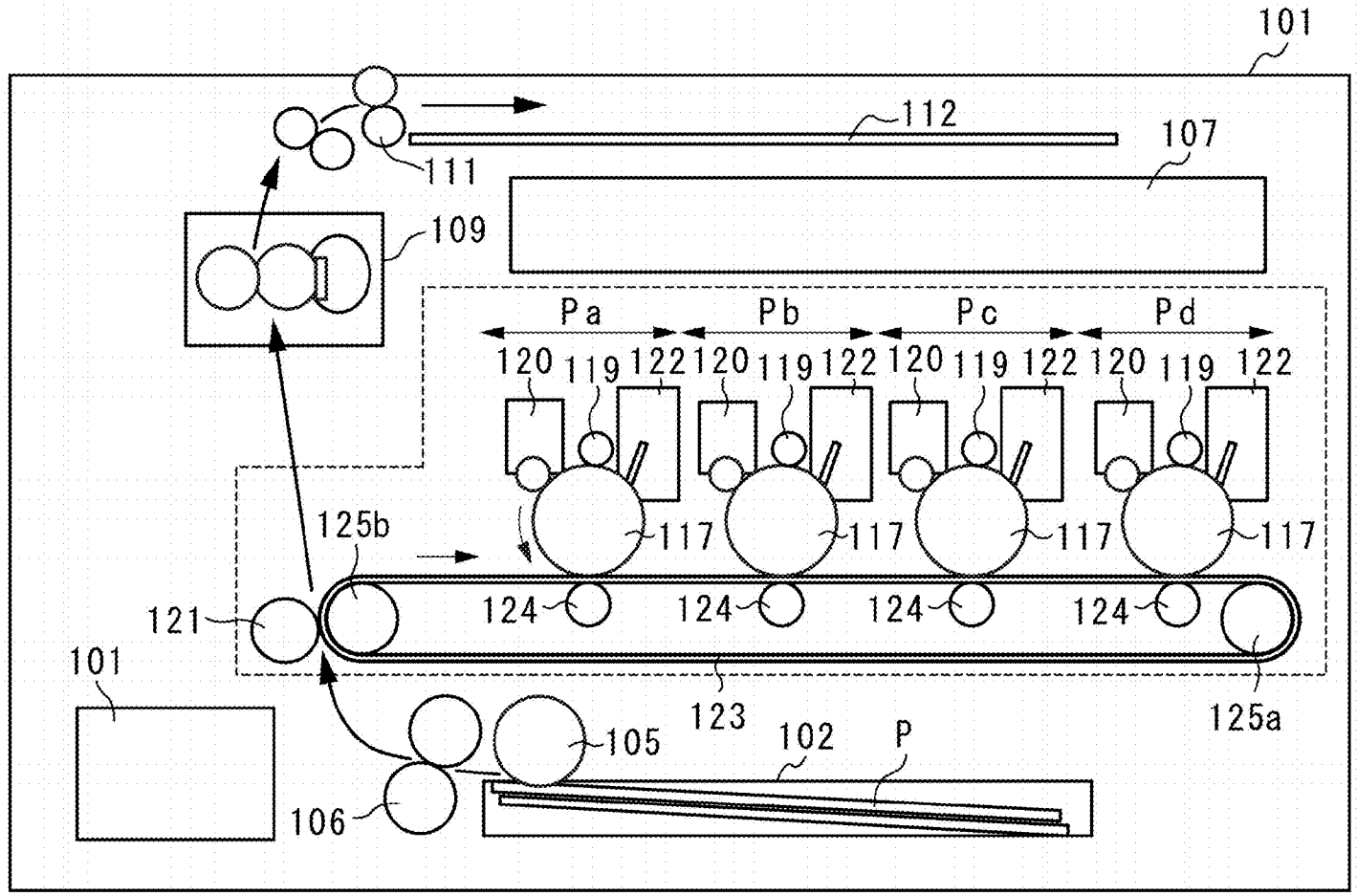
FIG. 1 is a schematic cross-sectional view illustrating a configuration of an image forming apparatus having a fixing apparatus according to a first exemplary embodiment.

FIG. 1 is a schematic cross-sectional view illustrating a configuration of a laser beam printer as an image forming apparatus according to a first exemplary embodiment of the present invention. The image forming apparatus according to the present exemplary embodiment is an in-line type image forming apparatus having a serially aligned first to fourth image forming units Pa, Pb, Pc, and Pd which form toner images using toner of yellow, magenta, cyan, and black, respectively as developer. Each of the image forming units Pa, Pb, Pc, and Pd includes a photosensitive drum 117 as an image bearing member.

In each of the image forming units Pa to Pd, a charging unit 119, a development unit 120, and a drum cleaner 122 are provided in a surrounding area of a corresponding one of a plurality of the photosensitive drums 117. At a position opposing the photosensitive drums 117, an intermediate transfer belt 123 is provided as an intermediate transfer member. The intermediate transfer belt 123 is looped over and stretched between a drive roller 125*a* for driving the intermediate transfer belt 123 and a secondary transfer counter roller 125*b*. In an upper part of the apparatus, an exposure device 107 is provided.

On the inner circumferential surface side of the intermediate transfer belt 123, primary transfer rollers 124 that form a primary transfer portion with the photosensitive drums 117 via the intermediate transfer belt 123 are provided. On the outer circumferential surface side of the intermediate transfer belt 123, a secondary transfer roller 121 that forms a secondary transfer portion with the secondary transfer counter roller 125*b* via the intermediate transfer belt 123 is provided.

In the image forming apparatus according to the present exemplary embodiment, a control unit 101 performs a predetermined image formation sequence according to a print instruction output from an external device (not illustrated) such as a host computer, a terminal device on a network, or an external scanner. The control unit 101 includes a central processing unit (CPU) and a memory such as a read-only memory (ROM) and a random access memory (RAM). The memory stores, for example, an image formation sequence, and various programs necessary for image formation.

With reference to FIG. 1, an image forming operation performed by the image forming apparatus according to the present exemplary embodiment will be described. The control unit 101 sequentially drives the image forming units Pa, Pb, Pc, and Pd according to an image formation sequence executed according to a print instruction. First, each of the photosensitive drums 117 is rotated in the direction indicated by the arrow at a predetermined circumferential velocity (process speed), while the drive roller 125*a* rotates the intermediate transfer belt 123 in the direction indicated by the arrow. In the image forming unit Pa for yellow as a first color, the surface of the photosensitive drum 117 is uniformly charged to a predetermined polarity and potential by the charging unit 119. Then, the exposure device 107 performs exposure and scanning onto the charged surface of the photosensitive drum 117 with a laser beam corresponding to image data. This forms an electrostatic latent image corresponding to the image data on the charged surface of the photosensitive drum 117. The electrostatic latent image is developed by the development unit 120 using yellow toner. With this operation, a toner image (developed image) of yellow is formed on the surface of the photosensitive drum 117.

Each of the operations of charging, exposure, and development is similarly performed in the image forming unit Pb for magenta as a second color, the image forming unit Pc for cyan as a third color, and the image forming unit Pd for black as a fourth color. The images of the respective colors formed on the surfaces of the photosensitive drums 117 are sequentially transferred onto the intermediate transfer belt 123 to overlap one another in the primary transfer portion. By this operation, a full-color toner image is borne by the intermediate transfer belt 123.

After the primary transfer, the drum cleaner 122 cleans the surface of the photosensitive drum 117 to prepare for the next image formation.

Meanwhile, a recording material P is fed one by one from a sheet feeding cassette 102 by a feeding roller 105 and conveyed to a registration roller 106. The recording material P is conveyed to the secondary transfer portion by the registration roller 106. At the secondary transfer portion, the toner image on the intermediate transfer belt 123 is transferred onto the recording material P. By this operation, an unfixed toner image is borne on the recording material P.

The recording material P bearing the toner image is guided into a fixing nip portion N1, which will be described below, in a fixing apparatus 109. At the fixing nip portion N1, the recording material P is heated while being conveyed, so that the toner image on the recording material P is heat-fixed to the recording material P. The recording material P that has passed the fixing nip portion N1 is discharged to a discharge tray 112 by a discharging roller 111.

(2) Fixing Apparatus

Figure 2:
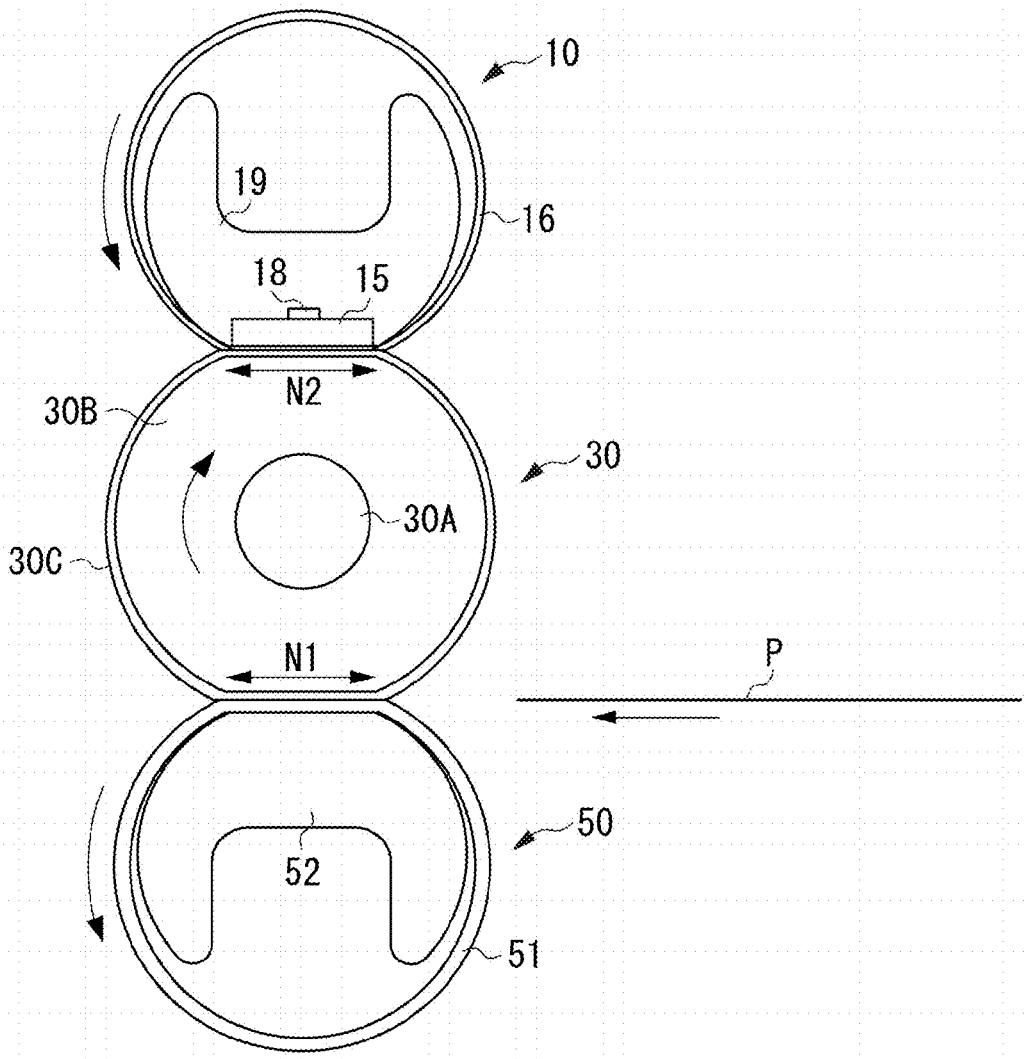
FIG. 2 is a cross-sectional view illustrating a configuration of the fixing apparatus according to the first exemplary embodiment.

In the following description, with respect to the fixing apparatus 109 and members constituting the fixing apparatus 109, the term "lengthwise direction" refers to a direction orthogonal to a recording material conveyance direction on the surface of the recording material P. The term "widthwise direction" refers to a direction parallel to the recording material conveyance direction on the surface of the recording material. The term "length" refers to a dimension in the lengthwise direction. The term "width" refers to a dimension in the widthwise direction. FIG. 2 is a schematic cross-sectional view illustrating a configuration of the fixing apparatus 109 according to the present exemplary embodiment. The fixing apparatus 109 is an external heating type fixing apparatus.

The fixing apparatus 109 according to the present exemplary embodiment includes a fixing roller 30, a heating unit 10 for heating the fixing roller 30, and a pressing unit 50 as a backup member. The fixing roller 30 is a member that is long in the lengthwise direction.

The fixing roller 30 includes a core metal 30A, a rubber layer 30B formed on the outside of the core metal 30A, and a release layer 30C formed on the outside of the rubber layer 30B. The core metal 30A is formed of a metallic material such as iron (Fe), stainless steel (SUS), or aluminum (Al). The rubber layer 30B is formed of, for example, silicone rubber. The release layer 30C is formed of, for example, polytetrafluoroethylene (PTFE), tetrafluoroethylene-perfluoroalkyl vinyl ether copolymer (PFA), or tetrafluoroethylene-hexafluoropropylene copolymer (FEP). In the fixing roller 30, both end portions of the core metal 30A in the lengthwise direction are rotatably supported by side plates (not illustrated) on both sides of an apparatus frame (not illustrated) in the lengthwise direction via bearings (not illustrated).

The heating unit 10 includes a heater 15, a cylindrical heating film 16 as a rotator for heating the fixing roller 30 (as a first rotator), and a heating film guide 19 that is in contact with the inner surface of the heating film 16 and guides the heating film 16. The heater 15 also serves as a member that forms a heat press-contact portion (heating portion) N2 with the fixing roller 30 via the heating film 16. At the heat press-contact portion N2, the heat of the heater 15 is transferred to the fixing roller 30 via the heating film 16.

The heating film guide 19 is formed of a heat resistant material and its cross section has an approximate U-shape. The both end portions of the heating film guide 19 in the lengthwise direction are supported by the side plates on the both sides of the apparatus frame in the lengthwise direction. The heating film guide 19 supports the heater 15 with a groove provided on a flat face of the heating film guide 19 in the lengthwise direction.

Figure 3:
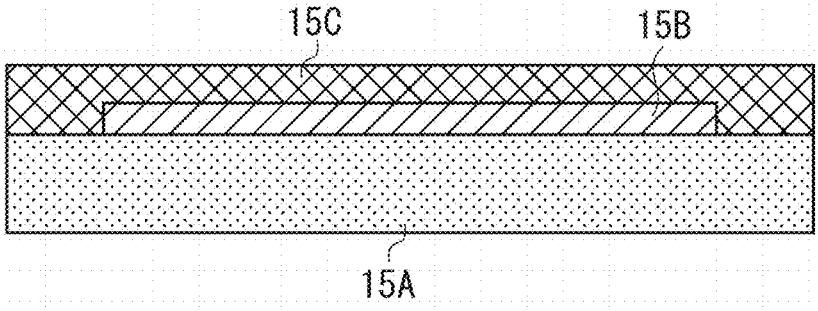
FIG. 3 is a schematic cross-sectional view illustrating a configuration of a heater according to the first exemplary embodiment.

With reference to FIG. 3, the configuration of the heater 15 will be described. FIG. 3 is a schematic cross-sectional view illustrating a configuration of the heater 15 used in the fixing apparatus 109 according to the present exemplary embodiment. The heater 15 includes a substrate 15A formed of ceramics such as alumina and aluminum nitride. On a surface of the substrate 15A where the substrate 15A is in contact with the heating film 16, a heat generation resistance layer 15B primarily formed of, for example, silver and palladium is provided in the lengthwise direction. The heat generation resistance layer 15B is covered with a protective layer 15C formed of glass or heat-resistant resin such as fluoro resin and polyimide.

The heating film 16 is formed so that the length of inner circumference of the heating film 16 is longer than the length of outer circumference of the heating film guide 19, and externally loose-fitted to the heating film guide 19. The heating film 16 includes a base layer formed of, for example, polyimide and a surface layer provided on the outside of the base layer and formed of, for example, PFA. The heating film 16 does not have a rubber layer. The heating unit 10 uses pressure springs (not illustrated) to urge both end portions of the heating film guide 19 in the lengthwise direction, in a direction orthogonal to a generatrix direction of the fixing roller 30 to form the heat press-contact portion N2 of a predetermined width. At the heat press-contact portion N2, the rubber layer 30B of the fixing roller 30 is compressed and elastically deformed at a position corresponding to the outer surface of the protective layer 15C of the heater 15. On the other hand, since the heating film 16 does not have a rubber layer, the hardness of the surface is high, and the heating film 16 is hardly deformed.

The pressing unit 50 includes a cylindrical pressing film 51 as a second rotator, and a pressing film guide 52 as a nip portion forming member. The pressing film guide 52 is formed of a heat resistant material and its cross section has an approximate U-shape. The both end portions of the pressing film guide 52 in the lengthwise direction are supported by the side plates on the both sides of the apparatus frame in the lengthwise direction. The pressing film 51 is externally loose-fitted to the pressing film guide 52.

The pressing film 51 is formed so that the length of inner circumference of the pressing film 51 is longer than the length of outer circumference of the pressing film guide 52. The pressing film 51 includes a base layer formed of, for example, polyimide and a surface layer formed of, for example, PFA. Similarly to the heating film 16, the pressing film 51 does not have a rubber layer. The pressing unit 50 uses pressure springs (not illustrated) to urge both end portions of the pressing film guide 52 in the lengthwise direction, in a direction orthogonal to the generatrix direction of the fixing roller 30 to form the fixing nip portion N1.

At the fixing nip portion N1, the rubber layer 30B of the fixing roller 30 is compressed and elastically deformed at a position corresponding to the flat surface of the pressing film guide 52. On the other hand, since the pressing film 51 does not have a rubber layer, the hardness of the surface is high, and the pressing film 51 is hardly deformed.

Figure 5:
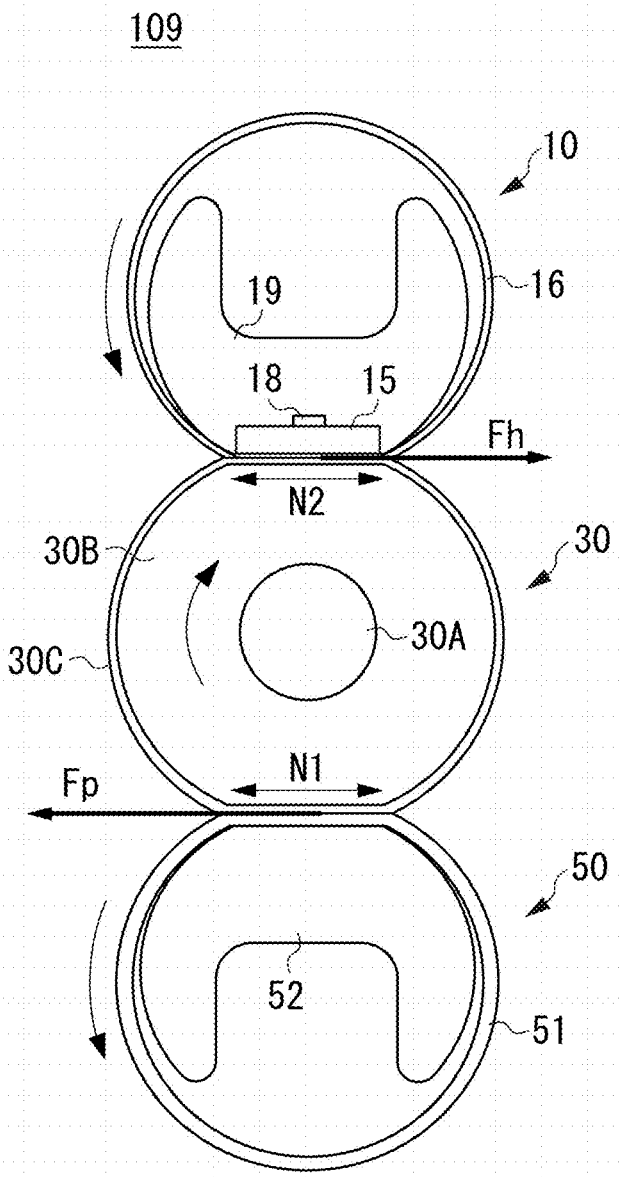
FIG. 5 illustrates frictional forces to be applied to a heating film and a pressing film when driving a fixing roller.

With reference to FIGS. 2 and 5, a drive configuration of the fixing apparatus 109 will be described. The control unit 101 drives and rotates a drive motor (not illustrated) as a drive source according to a print instruction. The rotation of an output shaft of the drive motor is transmitted to the core metal 30A of the fixing roller 30 via a gear train (not illustrated). With this rotation, the fixing roller 30 rotates in the direction indicated by the arrow at a predetermined circumferential velocity (process velocity). As illustrated in FIG. 5, the heating film 16 is rotated by a frictional force Fh received by the rotation of the fixing roller 30 at the heat press-contact portion N2. The pressing film 51 is rotated by a frictional force Fp received from the fixing roller 30 at the fixing nip portion N1.

Figure 4:
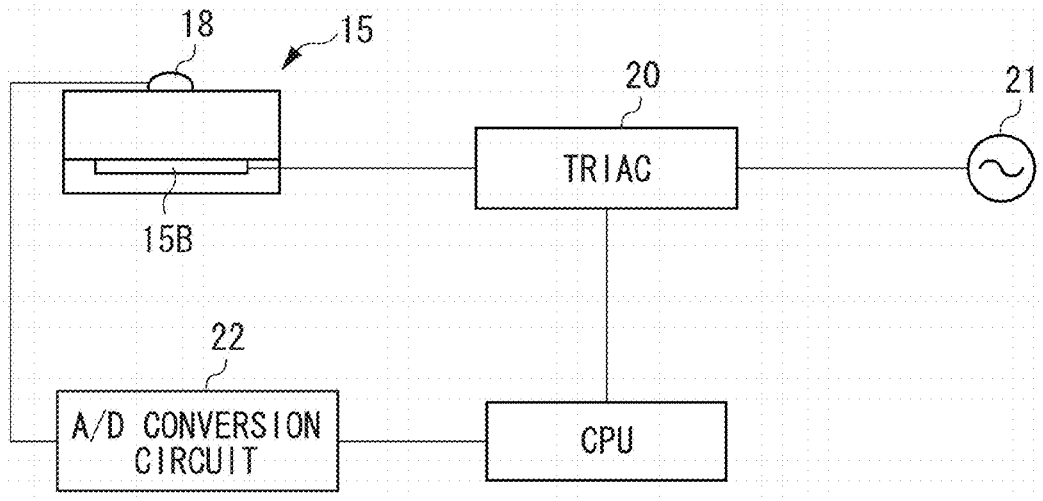
FIG. 4 is a cross-sectional view illustrating the heater and a block diagram illustrating a control unit of the heater according to the first exemplary embodiment.

With reference to FIG. 4, the control of the heater 15 will be described. The control unit 101 turns on a triac 20 according to the image formation sequence. The triac 20 controls the power applied from an alternating current (AC) power source 21, and starts supplying power to the heat generation resistance layer 15B of the heater 15. Then, the heat generation resistance layer 15B generates heat, and heats the heating film 16. The temperature of the heater 15 is detected by a thermistor 18, serving as a temperature detection member, provided on a surface of the substrate 15A that is opposite to the surface of the substrate 15A being in contact with the heating film 16. The control unit 101 obtains an output signal (temperature detection signal) from the thermistor 18 via an analog-to-digital (A/D) conversion circuit 22 and, based on the output signal, controls the triac 20 to maintain the detection temperature of the thermistor 18 at a target temperature.

The fixing roller 30 is heated by the heating film 16 at the heat press-contact portion N2. This provides the surface of the fixing roller 30 with an amount of heat that is necessary for heat-fixing an unfixed toner image T borne by the recording material P to the recording material P. In a state where the fixing roller 30 is driven and the heater 15 reaches the target temperature, the recording material P bearing the unfixed toner image T is guided into the fixing nip portion N1 in an orientation in which the unfixed toner image T makes contact with the fixing roller 30. The recording material P is heated at the fixing nip portion N1 while being conveyed, and the unfixed toner image T is heat-fixed to the recording material P.

Figure 7:
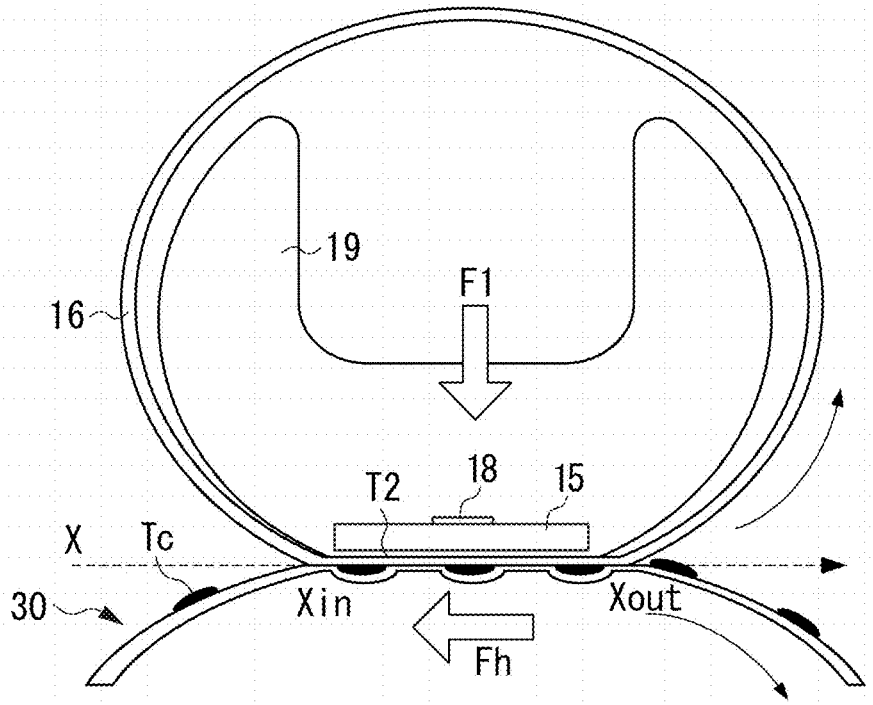
FIG. 7 illustrates a state of contamination before and after a heat press-contact portion according to the first exemplary embodiment.
Figure 8:
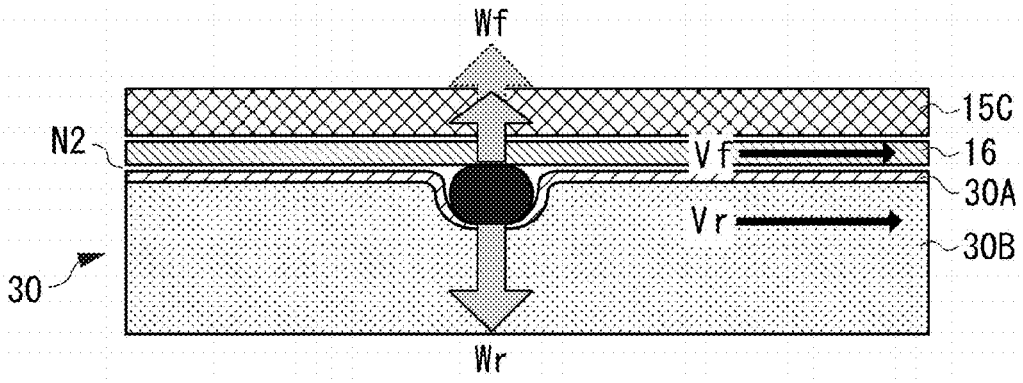
FIG. 8 illustrates a change in the adhesion of contamination to the heating film and the fixing roller when the fixing roller is elastically deformed at the heat press-contact portion.
Figure 10:
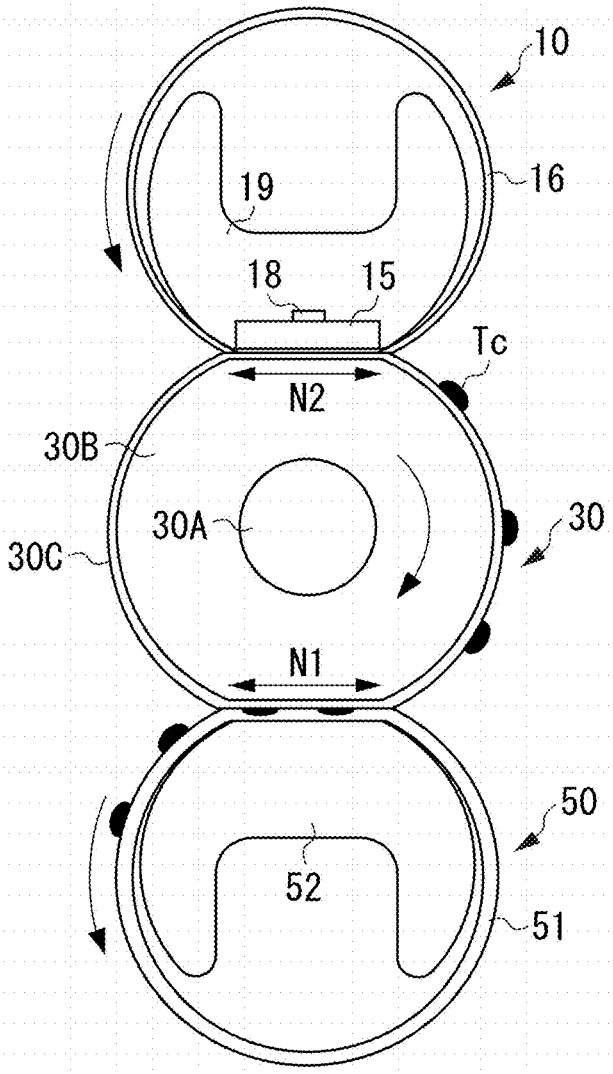
FIG. 10 illustrates movement of contamination in the fixing apparatus according to the first exemplary embodiment.

(3) Characteristic Configuration According to the Present Exemplary Embodiment FIG. 7 and FIG. 10 illustrate a moving path of the contamination Tc on the fixing device in this embodiment. FIG. 8 is a schematic view illustrating elastic deformation of the fixing roller 30 at the heat press-contact portion N2, and the force received by contamination Tc. It is considered that at the heat press-contact portion N2, the following two types of forces act on the contamination Tc held between the fixing roller 30 and the heating film 16.

Wr: an adhesion force of the contamination Tc to the fixing roller 30

Wf: an adhesion force of the contamination Tc to the heating film 16

If Wf is larger than Wr, the contamination Tc is likely to move from the fixing roller 30 to the heating film 16, and if Wf is smaller than Wr, the contamination Tc is likely to remain at the fixing roller 30. The adhesion forces Wf and Wr include, for example, the adhesion of toner, an intermolecular force, an electrostatic force, and mechanical adhesion to projections and depressions. Characteristic configurations for exerting a predominant effect on the adhesion forces Wf and Wr to prevent the contamination Tc from moving from the fixing roller 30 to the heating film 16 will be described according to the present exemplary embodiment.

The first configuration is that the micro hardness of the surface of the fixing roller 30 is lower than the micro hardness of the surface of the heating film 16. At the heat press-contact portion N2, the surface of the fixing roller 30 has a low micro hardness and is easy to be elastically deformed due to the rubber layer 30B. On the other hand, since the heating film 16 does not have a rubber layer, the surface of the heating film 16 has a high micro hardness and is hard to be elastically deformed. Consequently, the contamination Tc bites into the surface of the fixing roller 30, and a contact area of the fixing roller 30 and the contamination Tc is larger than a contact area of the heating film 16 and the contamination Tc. As a result, the adhesion force Wr becomes higher than the adhesion force Wf. Using only this configuration produces the effect of preventing the contamination Tc from moving from the fixing roller 30 to the heating film 16. However, if the contamination Tc is large in size with a high hardness, the contamination Tc may stick into the heating film 16, and adhere to the heating film 16. As a result, the adhesion force Wf becomes large, and the contamination Tc may easily separate from the fixing roller 30.

Figure 9:
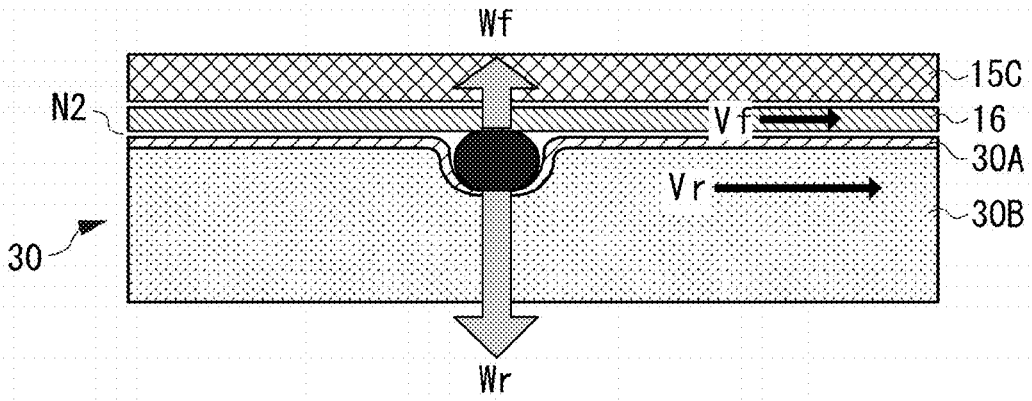
FIG. 9 illustrates a change in the adhesion of contamination to the heating film and the fixing roller when a shearing force acts between the contamination and the heating film at the heat press-contact portion according to the first exemplary embodiment.

Thus, the second configuration is that, in at least a partial region of the heat press-contact portion N2, a velocity difference ΔV is provided between a surface velocity Vf of the heating film 16 and a surface velocity Vr of the fixing roller 30. With reference to FIG. 9, the action of this configuration will be described. Between the contamination Tc biting into the surface of the fixing roller 30, and the heating film 16, a shearing force can be produced to separate the contamination Tc from the heating film 16. A shearing force is not produced in a case where the surface velocity Vf of the heating film 16 and the surface velocity Vr of the fixing roller 30 are the same. Thus, in the configuration in which a shearing force is produced between the heating film 16 and the contamination Tc, the adhesion force Wf of the contamination Tc to the heating film 16 is small, compared to that in the configuration in which no shearing force is produced. As the velocity difference ΔV increases, a shearing force increases and the adhesion force Wf decreases.

Herein, a specific configuration for providing the velocity difference ΔV between the surface velocity Vf of the heating film 16 and the surface velocity Vr of the fixing roller 30 in at least a partial region of the heat press-contact portion N2 will be described. In the configuration according to the present exemplary embodiment, the heating film 16 receives a frictional force on the contact surface with the fixing roller 30, and rotates. Thus, if both the outer diameter of the heating film 16 and the outer diameter of the fixing roller 30 are uniform in the whole area in the lengthwise direction, no velocity difference ΔV is produced. However, if the fixing roller 30 has a reverse crown shape in which the outside diameter increases from the central portion toward the end portion in the lengthwise direction, the surface velocity is faster at the end portion having a larger outer diameter than at the central portion having a smaller outer diameter. Consequently, at the heat press-contact portion N2, the velocity difference ΔV between the surface velocity Vf of the heating film 16 and the surface velocity Vr of the fixing roller 30 is produced in at least a partial region in the lengthwise direction. The velocity difference ΔV can be provided if at least one of the outer diameters of the fixing roller 30 and the heating film 16 is not uniform in the lengthwise direction. With respect to the velocity difference ΔV, its absolute value is important, and it does not matter whether which one of the surface velocities of the heating film 16 and the fixing roller 30 is faster.

As described above, in the present exemplary embodiment, the above two configurations can prevent the contamination Tc from moving from the fixing roller 30 to the heating film 16.

Meanwhile, the contamination Tc remaining on the fixing roller 30 leaves the heat press-contact portion N2 and then enters the fixing nip portion N1. While the recording material P is being conveyed at the fixing nip portion N1, the contamination Tc on the fixing roller 30 adheres to the recording material P and then discharged. In this case, since the amount of the contamination Tc is very small, the contamination Tc is not recognized as a defective image. On the other hand, while the recording material is not conveyed at the fixing nip portion N1, it is desirable that the contamination Tc adhering to the fixing roller 30 move from the fixing roller 30 to the pressing film 51. If the contamination Tc leaves the fixing nip portion N1 while remaining on the fixing roller 30, the contamination Tc enters the heat press-contact portion N2 again, and this increases the risk of adhesion of the contamination Tc to the heating film 16. If the contamination Tc is moved to the pressing film 51, the contamination Tc adhering to the pressing film 51 adheres to a surface of the recording material P being conveyed at the fixing nip portion N1, which is opposite to the image formation surface, so that the contamination Tc can be discharged.

Thus, in the fixing apparatus according to the present exemplary embodiment, a velocity difference ΔVp (second velocity difference) between a surface velocity of the pressing film 51 and a surface velocity of the fixing roller 30 in at least a partial region of the fixing nip portion N1 is made smaller than a velocity difference ΔVh (first velocity difference) between a surface velocity of the heating film 16 and a surface velocity of the fixing roller 30 in at least a partial region of the heat press-contact portion N2. An adhesion force Wfh of the contamination Tc to the pressing film 51 is made larger than an adhesion force Wfp of the contamination Tc to the heating film 16 to enable the contamination Tc to easily move from the fixing roller 30 to the pressing film 51 at the fixing nip portion N1.

Figure 6:
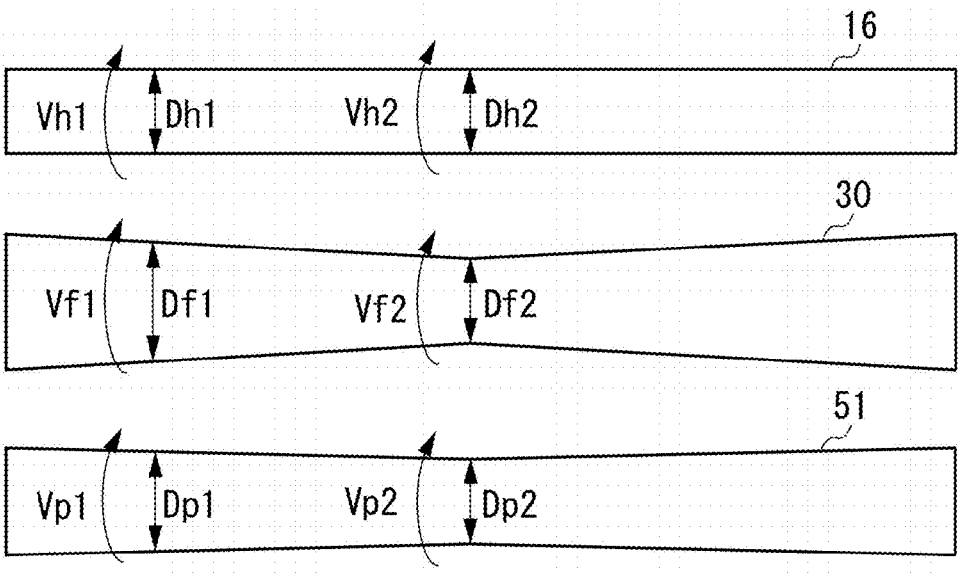
FIG. 6 illustrates shapes of the fixing roller, the heating film, and the pressing film in a lengthwise direction.

As a configuration for making the velocity difference ΔVp smaller than the velocity difference ΔVh, a configuration in which an outer diameter difference between the pressing film 51 and the fixing roller 30 is made smaller than an outer diameter difference between the heating film 16 and the fixing roller 30 is considered. FIG. 6 schematically illustrates outer diameter dimensions of the heating film 16, the fixing roller 30, and the pressing film 51.

The fixing roller 30 and the pressing film 51 each have a reverse crown shape in which the outer diameter increases from the central portion toward the end portion in the lengthwise direction. If it is assumed that the outer diameter of the fixing roller 30 at the point where the surface velocities of the fixing roller 30, the heating film 16, and the pressing film 51 are the same is Df1, and the outer diameter at any point other than the above-described point is Df2, and the surface velocities of the fixing roller 30 at Df1 and Df2 are Vf1 and Vf2, respectively, a relationship between Vf1 and Vf2 is expressed in the following expression.

$$Vf2=(Df2/Df1)\times Vf1$$

Similarly, a relationship between Vh1 and Vh2 in the heating film 16 and a relationship between Vp1 and Vp2 in the pressing film 51 are expressed in the following expressions.

$$Vh2=(Dh2/Dh1)\times Vh1$$

$$Vp2=(Dp2/Dp1)\times Vp1$$

The velocity difference ΔVh between the surface of the heating film 16 and the surface of the fixing roller 30, and the velocity difference ΔVp between the surface of the pressing film 51 and the surface of the fixing roller 30 at a point in the lengthwise direction are expressed as follows:

$$\Delta Vh=Vh2-Vf2=(Dh2/Dh1)\times Vh1-(Df2/Df1)\times Vf1$$

$$\Delta Vp=Vp2-Vf2=(Dp2/Dp1)\times Vp1-(Df2/Df1)\times Vf1$$

$$Vh1=Vf1=Vp1$$

Consequently, the velocity difference ΔVh and the velocity difference ΔVp are expressed as follows:

$$\Delta Vh=((Dh2/Dh1)-(Df2/Df1))\times Vf1$$

$$\Delta Vp=((Dp2/Dp1)-(Df2/Df1))\times Vf1$$

To make ΔVh larger than ΔVp, a relationship among the outer diameters is as follows:

$$|(Dh2/Dh1)-(Df2/Df1)|>|(Dp2/Dp1)-(Df2/Df1)|.$$

Next, a method for measuring the velocity differences ΔVh and ΔVp will be described. A non-contact rotation number measuring device is used to measure an angular velocity or the number of rotations per unit time for each of the surface of the heating film 16, the surface of the fixing roller 30, and the surface of the pressing film 51 and, based on the angular velocity (the number of rotations) and the outer diameter, a surface velocity is calculated. In a case where the velocity differences ΔVh and ΔVp vary depending on the temperature, the temperature of each of the members is adjusted to a temperature substantially equal to the temperature just before the recording material P enters the fixing nip portion N1 in an actual heat-fixing operation.

(4) Verification of Effectiveness

The effectiveness of the fixing apparatus according to the present exemplary embodiment was verified by experiment. The image forming apparatus used in the experiment is a laser beam printer having a process speed of 150 mm/s, and a throughput of 25 sheets/minute.

The configuration of the fixing apparatus according to the exemplary embodiment which was used in the experiment will be described. The heater 15 includes the substrate 15A formed of alumina with a thickness of 1.0 mm and a width of 7.0 mm, and the heat generation resistance layer 15B provided on the substrate 15A and formed of silver and palladium with a thickness of 10 μm and a width of 4.0 mm. The heater 15 is covered with a glass layer having a thickness of 60 μm as the protection layer 15C. The heating film 16 includes a base layer formed of polyimide resin with an inner diameter of 18 mm and a thickness of 50 μm, and a release layer provided on the base layer and formed of PFA resin with a thickness of 20 μm.

The micro hardness of the surface of the heating film 16 at the heat press-contact portion N2 was measured in the state of the heating unit 10, and the result was 90°. The micro hardness was measured using a micro rubber hardness tester MD-1 with a type A indenter (manufactured by KOBUNSHI KEIKI CO., LTD.). The fixing roller 30 includes the core metal 30A formed of aluminum with an outer diameter of 12 mm, and the rubber layer 30B provided on the core metal 30A and formed of silicone rubber with a thickness of 3.0 mm and a thermal conductivity of 0.1 W/m·k. Further, the release layer 30C formed of PFA resin with a thickness of 20 μm is provided as the outermost layer. The Asker C hardness of the surface of the fixing roller 30 was 45°. The Asker C hardness was measured using an Asker C hardness tester (manufactured by KOBUNSHI KEIKI CO., LTD.) with a load of 1 kgf. The micro hardness of the surface of the fixing roller 30 was 50°. In the fixing roller 30, a drive shaft (not illustrated) is supported by a bearing (not illustrated). For the bearing, a ball bearing is used to make the rotation resistance sufficiently small. The pressing unit 50 is formed by externally fitting the pressing film 51 to the pressing film guide 52 formed of LCP resin. The pressing film 51 includes a base layer formed of polyimide resin with an inner diameter of 18 mm and a thickness of 50 μm, and a release layer provided on the base layer and formed of PFA resin with a thickness of 20 μm. The micro hardness of the surface of the pressing film 51 at the fixing nip portion N1 in the state of the pressing unit 50 was 90°. The heater 15 is pressed by the fixing roller 30 by a pressing force of 18 kg via the heating film 16 to form the heat press-contact portion N2 with a width of 6.0 mm. The pressing film guide 52 is pressed against the fixing roller 30 by a pressing force of kg via the pressing film 51 to form the fixing nip portion N1 with a width of 6.0 mm.

Figure 11:
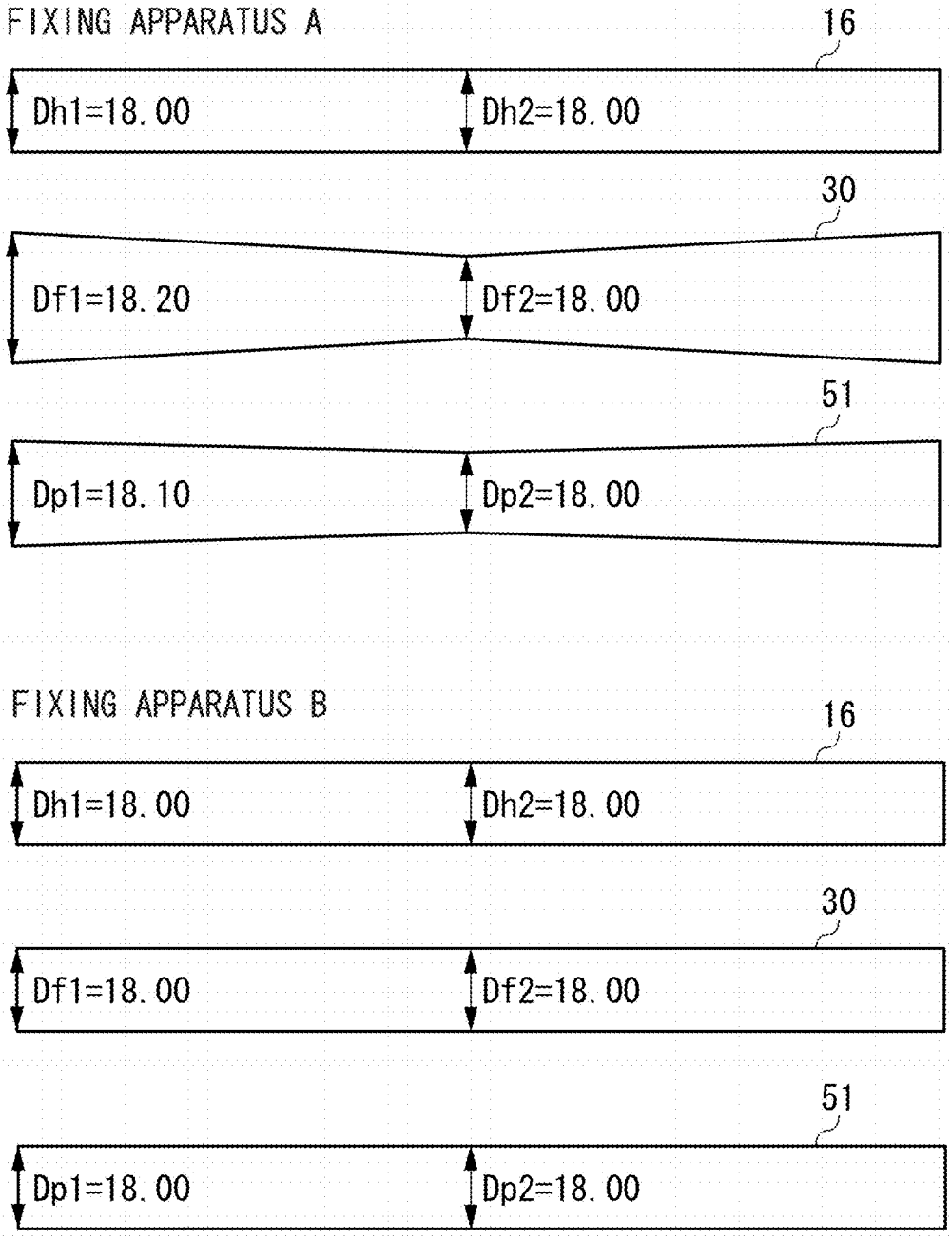
FIG. 11 illustrates shapes of the heating film, the fixing roller, and the pressing film in the lengthwise direction according to the first exemplary embodiment.

FIG. 11 is a schematic view illustrating dimensions of outer diameters of the heating film 16, the fixing roller 30, and the pressing film 51 in the fixing apparatus A according to the present exemplary embodiment, which was used in this experiment. The fixing roller 30 and the pressing film 51 of the fixing apparatus A each have outer diameter dimensions for forming a reverse crown shape in which the outer diameter increases from the central portion toward the end portion in the lengthwise direction, and the heating film 16 has an outer diameter dimension for forming a straight shape. A difference between the maximum outer diameter and the minimum outer diameter of the fixing roller 30 is 200 μm, a difference between the maximum outer diameter and the minimum outer diameter of the pressing film 51 is 100 μm, and there is no difference between the maximum outer diameter and the minimum outer diameter of the heating film 16 having a straight shape. That is, the outer diameter difference ΔDh between the heating film 16 and the fixing roller 30 is 200 μm at a maximum, and the outer diameter difference ΔDp between the pressing film 51 and the fixing roller 30 is 100 μm at a maximum. As a comparative example, a fixing apparatus B having the heating film 16, the fixing roller 30, and the pressing film 51 each having a uniform outer diameter in the lengthwise direction was used.

Using the fixing apparatus A and the fixing apparatus B, the velocity difference ΔVh between the surface of the heating film 16 and the surface of the fixing roller 30, and the velocity difference ΔVp between the surface of the pressing film 51 and the surface of the fixing roller 30 were measured in the entire area in the lengthwise direction. The results at the position where the maximum velocity differences were measured are shown in table 1.

TABLE 1

| | ΔDhmax (μm) | ΔDpmax (μm) | ΔVhmax (mm/sec) | ΔVpmax (mm/sec) |
|---|---|---|---|---|
| Fixing apparatus A | 200 | 100 | 1.2 | 0.7 |
| Fixing apparatus B | 0 | 0 | 0.1 | 0.1 |

In the fixing apparatus A used in the experiment, the maximum velocity difference ΔVhmax of 1.2 mm/s was measured at the central portion in the lengthwise direction. The maximum velocity difference ΔVpmax of 0.7 mm/s was measured. On the other hand, in the fixing apparatus B having no outer diameter difference, a very little velocity difference was produced. The very little velocity difference is considered to be caused by a sliding resistance between the heating film 16 and the heater 15 in the heating unit 10, or a sliding resistance between the pressing film 51 and the pressing film guide 52 in the pressing unit 50. The change in the surface velocity due to the sliding resistance largely depends on the wear in the units, and it is unstable. Thus, as described in the present exemplary embodiment, using the configuration in which outer diameter differences are provided between the films and the roller in the lengthwise direction realizes the unit that can provide stable surface velocity differences. If the outer diameter difference between the pressing film 51 and the fixing roller 30 in the lengthwise direction is made smaller than the outer diameter difference between the heating film 16 and the fixing roller 30 in the lengthwise direction, the velocity difference ΔVp can be made smaller than the velocity difference ΔVh. It is desirable that a difference between the outer diameter difference between the heating film 16 and the fixing roller 30, and the outer diameter difference between the pressing film 51 and the fixing roller 30 is 30 μm or more.

Using the image forming apparatus, a character image at a coverage rate of 5% was printed with A4-size paper (210 mm wide, 297 mm long) of grammage 80 g/m2 under an environment of a room temperature of 15° C. and humidity of 15%. With the fixing apparatus B as the comparative example, when printing was performed on 2000 sheets, an uneven gloss appeared in the fixed toner images on the printed recording materials P. We observed the inside of the fixing apparatus B, and found that an adhering substance such as the contamination Tc adhered to the heating film 16. In the fixing apparatus A according to the present exemplary embodiment, even after printing was performed on 30000 sheets, there was no adhesion of the contamination Tc to the heating film 16.

As described above, according to the present exemplary embodiment, the movement of contamination from the fixing roller to the heating film can be prevented.

In the present exemplary embodiment, a roller may be used instead of the heating film 16, and a roller may be used instead of the pressing film 51.

Figure 12:
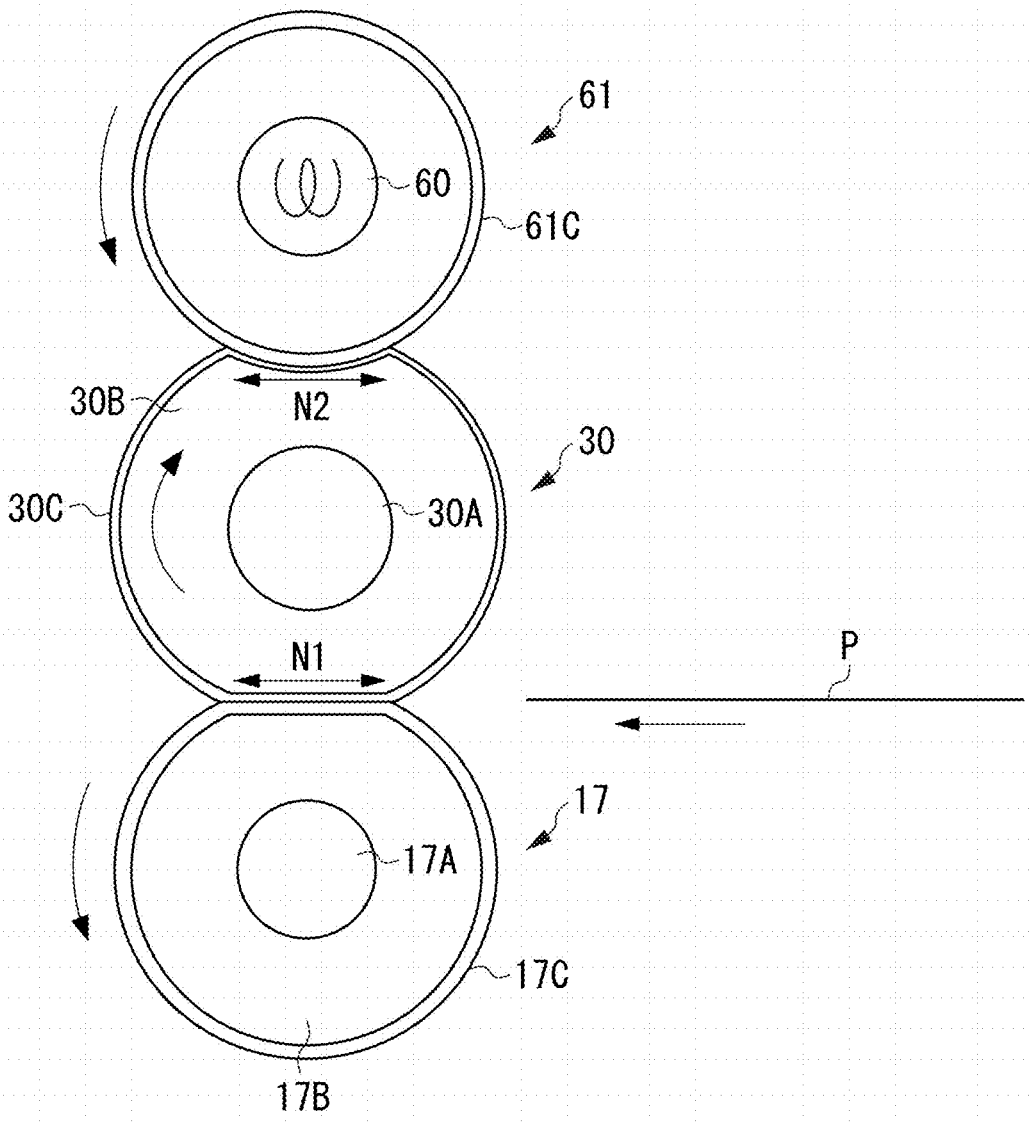
FIG. 12 is a cross-sectional view illustrating a configuration of a fixing apparatus according to a second exemplary embodiment.

Hereinafter, the second exemplary embodiment will be described. A fixing apparatus according to the present exemplary embodiment includes, as illustrated in FIG. 12, the fixing roller 30, a heating roller 61 (first rotator) having a halogen heater 60 therein, and a pressing roller 17. The heating roller 61 is in contact with the fixing roller 30 to form the heat press-contact portion N2 for heating the fixing roller 30. The pressing roller 17 is in contact with the fixing roller 30 to form the fixing nip portion N1 for conveying a recording material.

The heating roller 61 is formed of metal such as SUS, iron, and aluminum. The heating roller 61 is a hollow cylindrical member having a thickness of 0.3 to 3 mm. A release layer 61C formed of fluoro resin such as PTFE and PFA is provided as the outermost layer of the heating roller 61. The pressing roller 17 includes a core metal 17A formed of metal such as aluminum, a rubber layer 17B provided on the outside of the core metal 17A and formed of silicone rubber, and a release layer 17C provided on the outside of the rubber layer 17B and formed of fluoro resin such as PFA. The heating roller 61, the fixing roller 30, and the pressing roller 17 each have a uniform outer diameter in the lengthwise direction.

In the present exemplary embodiment, the heating roller 61 and the fixing roller 17 are rotated separately by individual drive sources (not illustrated). With this configuration, the number of rotations of the heating roller 61 and the number of rotations of the fixing roller 30 can be separately adjusted, and a velocity difference can be provided between their surface velocities. To provide no velocity difference between the surface of the fixing roller 30 and the surface of the pressing roller 17, the pressing roller 17 is driven and rotated by the fixing roller 30. In the present exemplary embodiment, the surface of the heating roller 61 is driven to rotate at a velocity of 98% with respect to the velocity of the surface of the fixing roller 30, and the surface of the pressing roller 17 and the surface of the fixing roller 30 rotate at the same velocity. The micro hardness of the heating roller 61 is 70°, the micro hardness of the fixing roller 30 is 50°, and the micro hardness of the pressing roller 17 is 60°.

The result of an experiment performed using the fixing apparatus according to the present exemplary embodiment, in a similar way to the first exemplary embodiment, showed that even after printing was performed on 30000 sheets, there was no adhesion of the contamination Tc to the heating roller 61.

As described above, according to the second exemplary embodiment, similarly to the first exemplary embodiment, the movement of contamination from the fixing roller to the heating roller can be prevented.

As a drive configuration according to the present exemplary embodiment, the heating roller 61 and the pressing roller 17 may be rotated separately by individual drive sources (not illustrated). As described in the first exemplary embodiment, the configuration in which the fixing roller 30 is driven in such a way that the heating roller 61 and the pressing roller 17 are driven and rotated by the rotation of the fixing roller 30 may be used in the present exemplary embodiment. In such a case, at least the outer diameter shape of the fixing roller 30 is made a reverse crown shape to produce a velocity difference between the surface of the fixing roller 30 and the surface of the heating roller 61 in at least a partial region in the lengthwise direction even in the driven rotation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent configurations and functions.

This application claims the benefit of Japanese Patent Application No. 2014-099837, filed May 13, 2014, which is hereby incorporated by reference herein in its entirety.

What is claimed is:

1. A fixing apparatus that heats, at a nip portion, a recording material, bearing a toner image, while conveying the recording material to fix the toner image on the recording material, the fixing apparatus comprising:

a roller;

a heating unit configured to be in contact with the roller to form a heating portion with the roller, the heating unit including a film, and a heating portion forming member configured to be in contact with an inner surface of the film and form the heating portion with the roller via the film; and a pressing rotator configured to be in contact with the roller and form the nip portion with the roller, wherein a micro hardness of a surface of the roller is lower than a micro hardness of a surface of the film at the heating portion, wherein a difference between a maximum outer diameter difference, between the film and the roller, and a maximum outer diameter difference, between the pressing rotator and the roller, is 30 μm or more, and wherein in at least a partial region of the heating portion, a velocity difference is provided between the surface of the roller and the surface of the film.

2. The apparatus according to claim 1, wherein in at least a partial region of the nip portion, a velocity difference is provided between the surface of the roller and a surface of the pressing rotator.

3. The apparatus according to claim 2, wherein a maximum value of the velocity difference between the surface of the roller and the surface of the film in at least a partial region of the heating portion is larger than a maximum value of the velocity difference between the surface of the roller and the surface of the pressing rotator in at least a partial region of the nip portion.

4. The apparatus according to claim 1, wherein the film is rotated by rotation of the roller, and wherein an outer diameter of the roller is larger at an end portion thereof than at a central portion thereof in a generatrix direction of the roller.

5. The apparatus according to claim 2, wherein an outer diameter of the pressing roller is larger at an end portion thereof than at a central portion thereof in a generatrix direction of the roller.

6. The apparatus according to claim 1, wherein an outer diameter of the film is the same at a central portion thereof and at an end portion thereof in a generatrix direction of the roller.

7. A fixing apparatus that heats, at a nip portion, a recording material, bearing a toner image, while conveying the recording material to fix the toner image on the recording material, the fixing apparatus comprising:

a roller;

a heating rotator configured to be in contact with the roller to form a heating portion with the roller; and a pressing rotator configured to be in contact with the roller and form the nip portion with the roller, wherein a micro hardness of a surface of the roller is smaller than either of a micro hardness of a surface of the heating rotator at the heating portion and a micro hardness of a surface of the pressing rotator at the nip portion, wherein a difference between a maximum outer diameter difference, between the heating rotator and the roller, and a maximum outer diameter difference, between the pressing rotator and the roller, is 30 μm or more, wherein a first velocity difference is provided between the surface of the roller and the surface of the heating rotator in at least a partial region of the heating portion, and a second velocity difference is provided between the surface of the roller and the surface of the pressing rotator in at least a partial region of the nip portion, and wherein a maximum value of the first velocity difference is larger than a maximum value of the second velocity difference.

8. The apparatus according to claim 7, wherein the heating rotator and the pressing rotator are rotated by rotation of the roller.

9. The apparatus according to claim 7, wherein an outer diameter of the roller is larger at an end portion thereof than at a central portion thereof in a generatrix direction of the roller, and an outer diameter of the pressing rotator is larger at an end portion thereof than at a central portion thereof in the generatrix direction of the roller.

10. The apparatus according to claim 7, wherein in a generatrix direction of the roller, an outer diameter difference between a central portion and an end portion of the roller is larger than an outer diameter difference between a central portion and an end portion of the pressing rotator.

* * * * *